US008151942B2

(12) United States Patent
Rusanen et al.

(10) Patent No.: US 8,151,942 B2
(45) Date of Patent: Apr. 10, 2012

(54) CONFIGURABLE COMMUNICATION SYSTEM FOR A BUILDING

(75) Inventors: Niko Rusanen, Helsinki (FI); Aapo Puskala, Helsinki (FI); Pekka Korhonen, Espoo (FI); Rauno Hatakka, Riihimaki (FI); Tomi Järvinen, Hämeenlinna (FI); Niko Elomaa, Hyvinkää (FI)

(73) Assignee: Kone Corporation, Helsinki (FI)

( * ) Notice: Subject to any disclaimer, the term of this patent is extended or adjusted under 35 U.S.C. 154(b) by 951 days.

(21) Appl. No.: 12/216,311

(22) Filed: Jul. 2, 2008

(65) Prior Publication Data

US 2009/0022131 A1 Jan. 22, 2009

Related U.S. Application Data

(63) Continuation of application No. PCT/FI2007/000028, filed on Feb. 6, 2007.

(30) Foreign Application Priority Data

Feb. 13, 2006 (FI) ..... 20060131

(51) Int. Cl.
*B66B 1/28* (2006.01)

(52) U.S. Cl. ..... 187/247; 187/391

(58) Field of Classification Search ..... 187/247, 187/248, 308–388, 391–396; 707/609; 715/200, 715/700, 810–812
See application file for complete search history.

(56) References Cited

U.S. PATENT DOCUMENTS

| | | | | |
|---|---|---|---|---|
| 5,541,585 | A * | 7/1996 | Duhame et al. | 340/5.62 |
| 5,689,094 | A * | 11/1997 | Friedli et al. | 187/384 |
| 5,832,363 | A | 11/1998 | Moriya et al. | |
| 6,223,160 | B1 * | 4/2001 | Kostka et al. | 704/275 |
| 6,382,363 | B1 * | 5/2002 | Friedli | 187/384 |
| 6,615,175 | B1 * | 9/2003 | Gazdzinski | 704/275 |
| 6,801,792 | B1 * | 10/2004 | Schuster et al. | 455/566 |
| 6,868,945 | B2 * | 3/2005 | Schuster et al. | 187/380 |
| 6,986,408 | B2 * | 1/2006 | Takeuchi | 187/380 |
| 7,162,233 | B2 * | 1/2007 | Chiba | 455/420 |
| 7,319,966 | B2 * | 1/2008 | Friedli et al. | 705/346 |
| 7,353,915 | B2 * | 4/2008 | Zaharia et al. | 187/388 |
| 7,882,938 | B2 * | 2/2011 | Blackaby et al. | 187/388 |
| 7,936,249 | B2 * | 5/2011 | Friedli | 340/5.5 |
| 2003/0159890 | A1 | 8/2003 | Schuster et al. | |

(Continued)

FOREIGN PATENT DOCUMENTS

EP 1 132 647 A1 9/2001

(Continued)

*Primary Examiner* — Anthony Salata
(74) *Attorney, Agent, or Firm* — Birch Stewart Kolasch & Birch, LLP

(57) ABSTRACT

The present invention deals with a method and system for producing services in the communication system of a building. In the method of the invention, the communication system includes at least one terminal device applicable for local-area communication, at least one communication unit, at least one server controlling the communication system, at least one base station for implementing a local-area network in the communication system, and a local network for implementing mutual data transfer between the communication unit, the server controlling the communication system and the base station. In the method, a number of service folders are generated in the terminal device and a service folder applicable to the purpose in each case is selected. From the selected service folder, a service request is selected which is transmitted from the terminal device to the communication system, where the service request is executed in one or more sub-stages using one or more communication units.

28 Claims, 7 Drawing Sheets

U.S. PATENT DOCUMENTS

Figure 1:
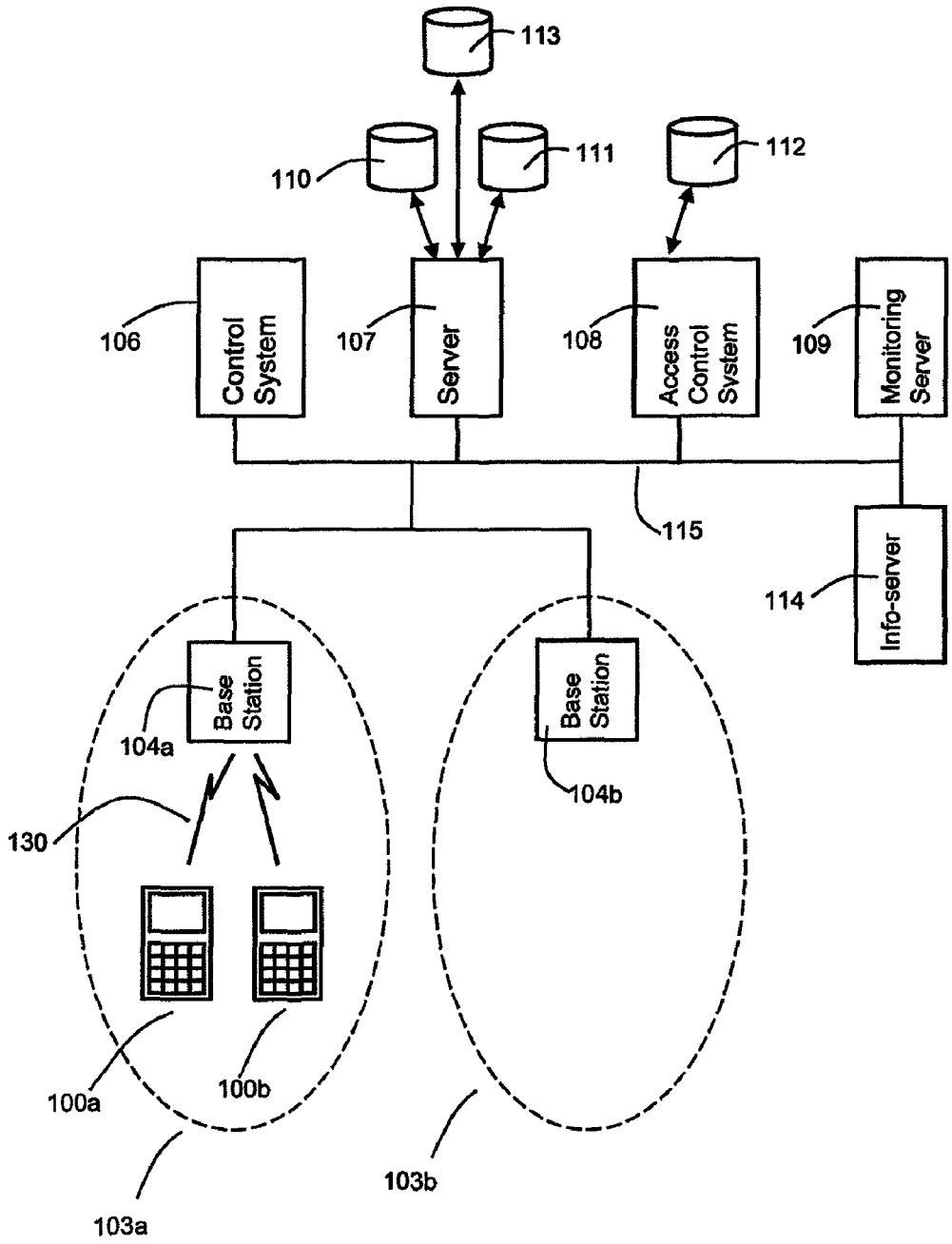

| | | | |
|---|---|---|---|
| 2004/0060777 | A1 | 4/2004 | Takeuchi |

FOREIGN PATENT DOCUMENTS

| | | | |
|---|---|---|---|
| EP | 1 457 452 | A1 | 9/2004 |
| JP | 2002-128406 | A | 5/2002 |
| JP | 2005-330036 | A | 12/2005 |
| WO | WO-01/83351 | A1 | 11/2001 |
| WO | WO-2006/000618 | A2 | 1/2006 |
| WO | WO-2006/005789 | A2 | 1/2006 |

* cited by examiner

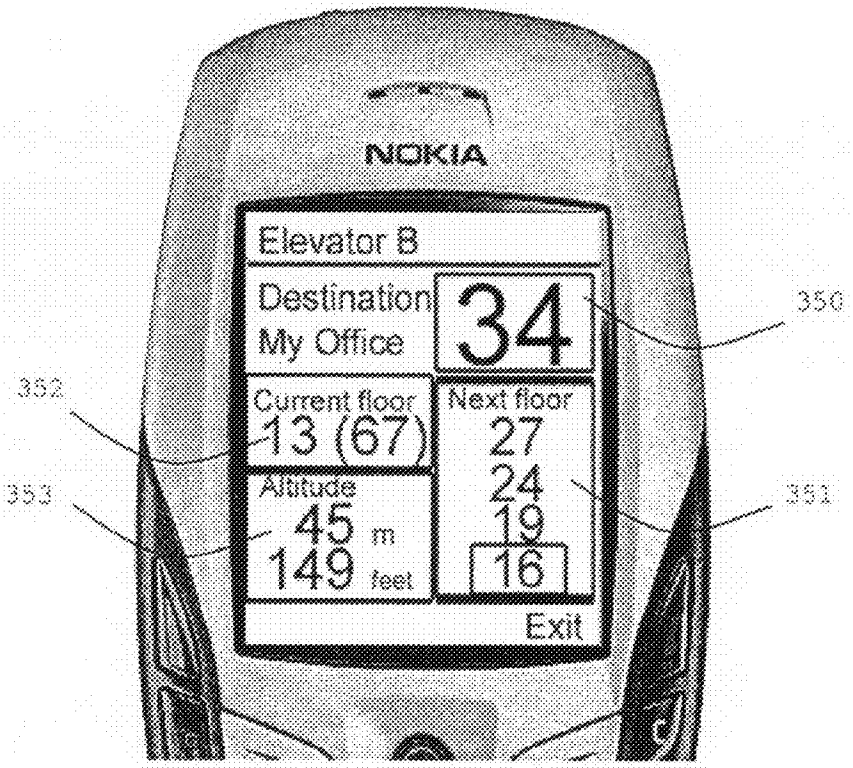
Fig. 3e, Execution view in elevator
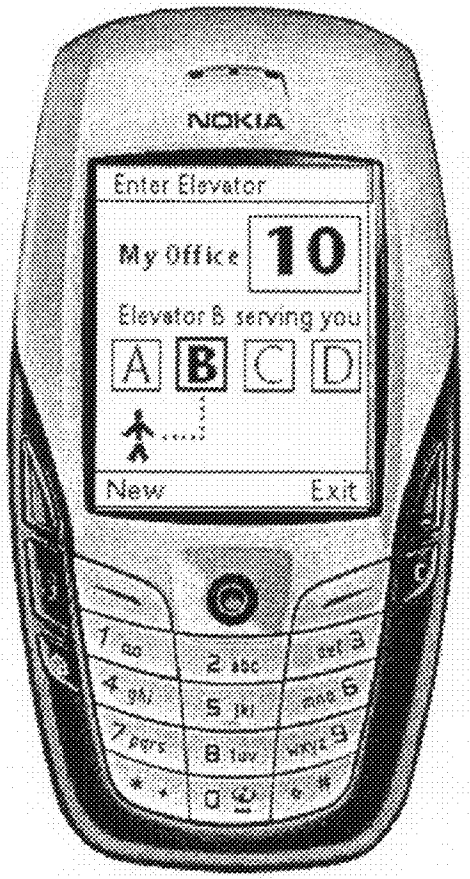
Fig. 3f,

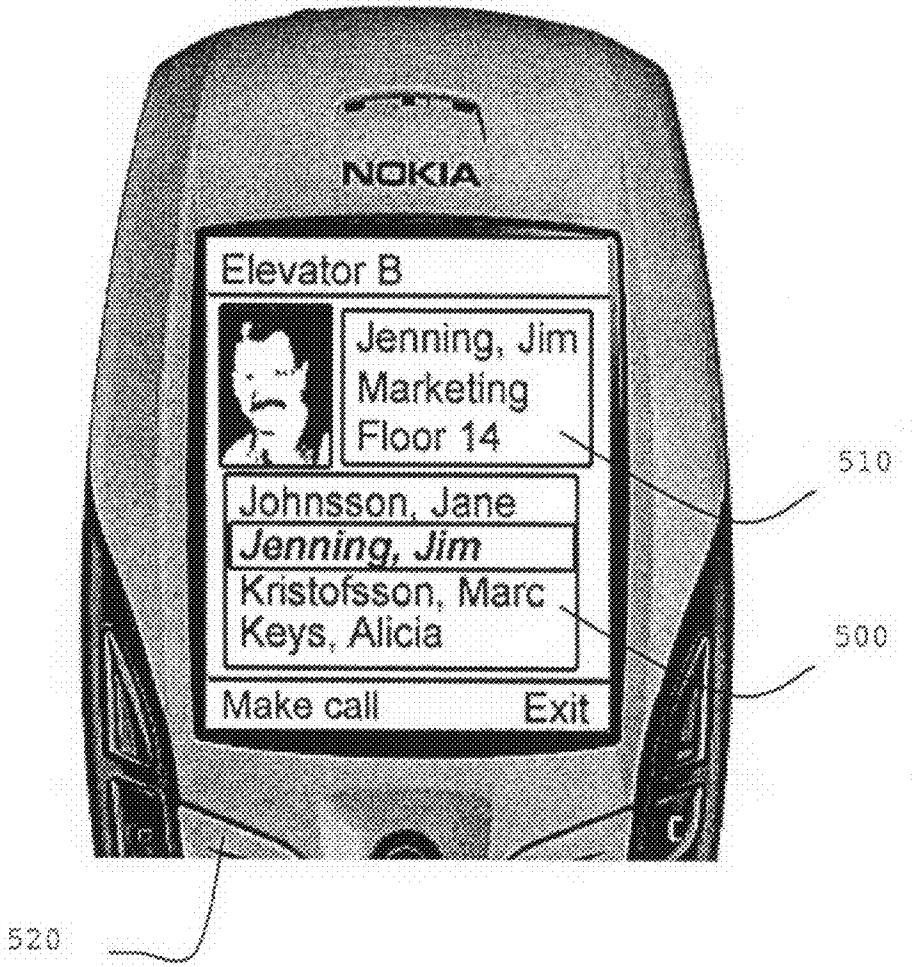
Fig. 5, Tenant-folder

CONFIGURABLE COMMUNICATION SYSTEM FOR A BUILDING

This application is a Continuation of copending PCT International Application No. PCT/FI2007/000028 filed on Feb. 6, 2007, which designated the United States, and on which priority is claimed under 35 U.S.C. §120. This application also claims priority under 35 U.S.C. §119(a) on Patent Application No(s). 20060131 filed in Finland on Feb. 13, 2006. The entire contents of each of the above documents is hereby incorporated by reference.

FIELD OF THE INVENTION

The present invention relates to traveling of people in buildings. In particular, the present invention relates to a method and a system for producing services in the communication systems of buildings.

BACKGROUND OF THE INVENTION

Multi-floor buildings typically contain numerous elevators, escalators, automatic doors, gates, information displays and similar communication means for guiding, directing and transporting people from one place to another in the building. When moving about in the building, to reach his/her destination, the passenger has to issue service requests to the communication system, such as elevator calls, operating commands for automatic doors or service requests relating to the guidance information and other information. Such service requests are generally input manually using push buttons, keypads, touch-screens or other corresponding manually operated user interfaces, which are fixedly mounted in the building or in conjunction with a communication means. For the display of guidance and other information, display panels, signals and/or floor-specific information boards are used. Systems have also been developed in which the passenger can e.g. issue an elevator call using a wireless terminal, such as an RFID transponder or mobile telephone. There may also be restrictions regarding passengers' access to certain parts of the building, in which case the passenger has to use various personal identification methods to gain access to a desired space in the building.

Prior-art solutions have several significant drawbacks. They are ill or not at all suited for situations where the communication system of the building comprises several different communication means providing services that the passenger has to utilize in order to reach his/her destination. The passenger has to issue in the communication system a plurality of successive service requests, such as e.g. elevator calls and operating commands for automatic doors, as it is not possible to enter service requests comprising several operations from the same user interface or terminal device. In such situations, the passenger must use several different user interfaces and/or terminal devices to enter the necessary service requests so as to reach his/her destination or to obtain desired information regarding the building. This naturally retards and complicates the passenger's progress towards the destination. Modern office buildings also typically contain areas of different security levels, for admission to which the passenger is identified using various identification methods or combinations of identification methods, such as electrically readable identification codes and/or PIN codes/passwords. In traditional solutions, in order to access areas having different security levels, the passenger is required to use several access control devices of different types, which increases the complexity of the access control system of the building as well as passengers' traveling in the building.

In prior-art solutions, it is additionally not possible for the passenger to make personal definitions (personalize) as to what services and in what manner he/she is to be provided in the communication system, because the functions of the terminal device are either permanently programmed in the terminal device or the required software and control data for the operation of a given communication means are downloaded into the terminal device instantaneously from a communication server provided with programs and control data whose content the passenger can not manipulate in any way. Therefore, the passenger cannot personalize the content or functionality of the services that he/she is to be provided nor the choice of services he/she is to be provided. Moreover, in those solutions, the process of downloading the software and control data into the terminal device often takes an unreasonably long time before the passenger can enter the desired service request, causing repeated frustration of the passenger. A specific drawback in prior-art solutions is that the passenger is not offered services grouped into logical combinations such that the passenger could easily and quickly select his/her services from a set that best represents his/her needs in different traveling situations.

OBJECT OF THE INVENTION

The object of the present invention is to overcome some of the above-described drawbacks encountered in prior-art solutions. A further object of the invention is to accomplish one or more the following objectives:

- to enable the passenger's service requests to be stored in the communication system beforehand,
- to provide information services and real-time information to the passenger about the communication system before activation of service requests as well as during execution of service requests,
- to automatically offer the passenger services that he/she is most likely to need,
- to enable inter-communication between passengers from one terminal device to another.

BRIEF DESCRIPTION OF THE INVENTION

The method of the invention is characterized by what is disclosed in the characterization part of claim 1. The system of the invention is characterized by what is disclosed in the characterization part of claim 16. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

Below are definitions of the specific meaning of certain terms used in this context:

The term "building" refers to any construction designed for human occupation, such as a residential building, office building, hospital, airport, trade center, multistory garage, and to areas immediately adjoining such a construction, such as parking lots, terminals and other corresponding areas.

The term "communication means" refers to a system which communicates with a server in the communication system over a local data network and which is used to execute an operation implied by a service request. Possible examples of communication means include elevator systems, automatic doors, escalators, passenger conveyors, information displays, working hour monitoring systems, air conditioning systems, lighting control systems, access control systems, or some other corresponding systems.

The term sub-stage refers to a traveling process associated with the execution of a service request, such as e.g. elevator allocation, waiting for an elevator, actual traveling, input of PIN code/password.

The method of the invention for producing services in a communication system in a building, said communication system comprising at least one terminal device suited for local-area communication, at least one communication means, at least one server controlling the communication system, at least one base station for implementing a local-area network in the communication system, and a local network for implementing mutual data transfer between the said communication means, the said server controlling the communication system and the said base station, comprises generating a number of service folders in the terminal device and selecting a service folder applicable to the purpose in each case. From the selected service folder, a service request is selected, and the service request is transmitted from the terminal device to the communication system and executed in one or more sub-stages using one or more communication means.

In an embodiment of the invention, the passenger's right of execution implied by the service request is verified to accept or reject the service request. In this embodiment, the passenger does not need a separate terminal device to obtain the right of execution of the service request.

In an embodiment of the invention, one or more default service requests are defined for the passenger, and each request is automatically selected as the passenger's service request depending on where the passenger is located in the communication system and/or on the traveling instant of time. The default service request may be permanent or it may be determined on the basis of the service request that the passenger issued the previous time. This embodiment makes repeated traveling in the building easier for the passenger because the terminal device automatically supplies a service that the passenger is most likely to need.

In an embodiment of the invention, one or more service requests assigned to the passenger are stored on a server in the communication system, and the service request is executed when the passenger comes within the range of the local-area network of the communication system. In this embodiment, the passenger can plan his/her traveling route beforehand or some other party utilizing the communication system can assist him/her to reach his/her destination in the building.

In an embodiment of the invention, the service folders in the terminal device are updated automatically from the server of the communication system when the passenger comes within the range of the local-area network. This embodiment permits the passenger to always have access to up-to-date information regarding the services available in the communication system.

In an embodiment of the invention, the set of service folders to be formed in the passenger's terminal device comprises at least one of the following service folders; tenant folder; destination folder; info folder; emergency folder. In this embodiment, typical service folders grouped according to different practical needs are available to the passenger.

In an embodiment of the invention, a passenger registered in the communication system defines the information content of the tenant folder in respect of information relating to him/herself. In this embodiment, a resident or some other person having business in the building is able to impose restrictions in the communication system regarding the transfer of information concerning his/her own privacy.

In an embodiment of the invention, status data relating to the service request selected from the service folder is transmitted to the passenger's terminal device. This embodiment allows the passenger to have real-time information about the communication systems and to plan his/her trip in the building better.

In an embodiment of the invention, the status data transmitted to the passenger's terminal device consists of real-time information regarding the accessibility and/or place where the object selected from the tenant folder is located in the communication system of the building. This embodiment allows the passenger to time his/her visit correctly and to avoid useless traveling in the building.

In an embodiment of the invention, a message indicating the passenger's arrival in the building or his/her exit from the building is transmitted in conjunction with the service request to a working hour monitoring system connected to the communication system. This embodiment allows the passenger, using only one service request, to travel to/from his/her place of work and at the same time to log in/out to/from the working hour monitoring system.

In an embodiment of the invention, the beginning and/or end of one or more sub-stages of the service request are/is indicated in the terminal device by vibration alarm and/or sound alarm. This embodiment permits the passenger to be advised of events related to his/her traveling, thus allowing the passenger to move more quickly and easily from one place to another in the building.

In an embodiment of the invention, the passenger's personal terminal device is one of the following terminal devices: mobile telephone; PDA device (Personal Digital Assistant); portable computer. Thus, the passenger can issue service requests from a general-purpose device that he may also use for other purposes.

In an embodiment of the invention, one or more of the following properties of the terminal device are personalized:

- activation of hands-free functions
- defining of personal traveling needs
- activation of sound and/or vibration alarms indicating the beginning or end of sub-stages of service requests
- selection of the language used by the terminal device in connection with service requests
- modification of the contents of the service folders of the terminal device.

Utilizing personalized properties, the passenger can configure in his/her terminal device the functions that best serve his/her needs in the communication system.

In an embodiment of the invention, wherein the passenger uses an elevator as a communication means, items of information are indicated on the passenger's terminal device during one or more sub-stages, said items including one or more the following items of information: elevator allocated to the passenger, passenger's destination floor, number of the current floor of the elevator allocated to the passenger, next stopping floors for the elevator allocated to the passenger, change floor in case the service request comprises several passages to be traveled on different elevators. Such information guides the passenger so he/she can reach his/her destination floor quickly and reliably.

The present invention provides significant advantages as compared to prior-art solutions. The passenger only needs to have one terminal device, by means of which he can issue the necessary service requests easily and quickly so that the communication system functions required for the journey are activated from the same terminal device. The passenger can also personalize the functions and service folders of the terminal device as desirable. It is possible to group the service requests offered to the passenger so as to allow the passenger to quickly and easily select the service request he/she needs. In addition, the passenger receives real-time information about the communication system both before activation of the service request and during different sub-stages of execution of the service request. Other advantages afforded by the invention were already described in connection with different embodiments of the invention.

LIST OF FIGURES

FIG. 1 presents a communication system according to the invention,

FIGS. 2-5 present a few displays according to the invention relating to the use of the passenger's terminal device.

DETAILED DESCRIPTION OF THE INVENTION

The present invention relates to a method and system for producing services in the communication system of a building. FIG. 1 presents an example of the communication system of the invention. The communication system 1 comprises a number of terminal devices 100*a*, 100*b* provided with a Bluetooth connection, base stations 104*a*, 104*b* of a local-area network 103, an elevator group (not shown in FIG. 1) including an elevator group control system 106, a server 107 coordinating the communication system, an access control server 108, a working hour monitoring server 109, an info-server 114 and a local network 115 connecting these. The local fields 103*a*, 103*b* of the base stations form the local field 103 of the communication system. To produce service requests, a terminal software package is installed in the terminal devices in a place chosen by the passenger, e.g. within the local-area network of the communication system or in the passenger's home over an Internet connection, a common mobile telephone network or some other applicable data transfer connection from a server from which the terminal software package can be downloaded (not shown in FIG. 1). The terminal software consists of general-purpose software applicable for use in all communication systems compatible with FIG. 1. The function of the software is to transmit service requests and information between the passenger's terminal device and the rest of the communication system. The passenger can use the terminal software at any time to personalize functions and to issue service requests offered for application. To activate the use of the services of the communication system 1, the passenger has to be registered as a passenger using the communication system, either by the passenger him/herself or by some other party authorized to do so. The registration may be effected via the same server from which the terminal software is downloadable or via some other server (not shown in FIG. 1) intercommunicating with the communication system. In conjunction with the registration, a number of service folders are stored in the terminal device as a default set of folders relating to the communication system in which the user is being registered. If the user registers him/herself as a user of more than one communication system, it is correspondingly possible to download into his/her terminal device sets of service folders concerning the communication systems in question. In conjunction with the registration, the identification code of the passenger's terminal device as well as other registration data needed are transmitted to and stored on the communication system server 107, to be further transmitted to the base stations 104*a*, 104*b*. After registration, the passenger's terminal device and the base stations of the communication system 1 are able to intercommunicate when the passenger is within the range of the local-area network 103 of the communication system. In the example in FIG. 1, the local-area network 103 is implemented using Bluetooth technology, but instead of Bluetooth technology it is possible to use any communication technology applicable for short-range communication, such as WLAN technology or infrared technology. The base stations are located in different spaces in the building so as to provide the desired coverage.

In the communication system presented in FIG. 1, the terminal devices of passengers registered in the communication system are scanned by the base stations 104*a*, 104*b* on the basis of the terminal device identification code, e.g. the Bluetooth identification code of the terminal device. When a passenger registered in the communication system arrives in the building, one of the base stations 104*a*, 104*b* identifies the passenger's terminal device on the basis of the terminal device identification code and activates a communication connection 130 between the base station and the terminal device. Information indicating the passenger's arrival within the range of the local-area network 103 is transmitted from the base station having performed the identification to the communication system server and to the other base stations, said information comprising passenger identification data, such as e.g. the aforesaid identification code of the terminal device and data identifying the location of the base station in the building. In the same connection, an identifier identifying the communication system is transmitted from the base station to the terminal device. As the passenger is moving in the communication system, the aforesaid passenger identification and location data is updated on the communication system server and the other base stations according to which base station's local field 103*a*, 103*b* the passenger is currently in. The communication system server and the base stations thus have real-time information regarding passengers present within the communication system and their location in the building.

One of the functions of the communication system server 107 is to coordinate the execution of service requests in the communication system. It receives the service requests issued by the passenger, verifies the passenger's right of execution to service requests, activates communication means implementing service requests and transmits messages and information relating to service requests within the communication system. The communication system server also contains updated service folders of the communication system in a database 110, ready to be uploaded and updated to the passenger's terminal device when the passenger arrives in the building. The service folders are formed by arranging service requests according to practical need into different categories, thus making it easy for the passenger to find and select a desired service by means of his/her terminal device. Below are some examples of possible service folders:

Tenant folder: Using this folder, the passenger can focus service requests on persons living or having business in the building. By selecting the name of a desired person in the tenant folder, the passenger can issue as a service request e.g. an elevator destination call to the destination floor determined by the name, send a message or phone the terminal device determined by the name. The passenger can also receive to his/her terminal device real-time information regarding accessibility of the person in question, such as e.g. information as to whether the person is located in the assumed place in the building or in some other space in the building or whether he/she is at all in the building, and information regarding a possible time of return of the person or some other circumstance relating to accessibility.

Destination folder: Via this folder, the passenger can focus service requests on companies, restaurants, offices and corresponding communities located on different floors in the building. By selecting a desired name in the destination folder, the passenger can issue as a service request e.g. an elevator call to the reception floor of a company or report to the reception of the company on his/her arrival in the entrance hall of the building.

Info-folder: Via this folder, the passenger can request various information services available in the building to be provided to his/her terminal device, such as e.g. news services, guidance information, weather services, schedules of transportation means or other corresponding information services. The use of an information service may be subjected to payment and require the passenger to register as a user of the service.

Emergency folder: Via this folder, the passenger can execute service requests relating to emergency situations, e.g. order an elevator to the evacuation floor of the building, report about an elevator stuck between floors, report about cases of illness or other corresponding needs for help.

The service folders are maintained by a party assigned or authorized to perform this function. The tenant folder may also be maintained by the holder of the name as regards his/her own data. The communication system-specific service folders of the terminal device are generated in one or more stages, including:

downloading of the service folders of the communication system by default into the terminal device in connection with the passenger registering as a user of the communication system, modification of the content of the service folders by the passenger using the terminal software installed in the terminal device. The passenger can remove services from the service folders of the terminal device, change and/or add services. The passenger can also create new service folders and/or remove service folders from the terminal device.

downloading of updated information about the service folders into the passenger's terminal device from the database 110 by the communication system when the passenger arrives within the range of the local-area network of the building. The updating preferably concerns only those services to which the passenger has a right of execution and only changed data. If one or more of the service folders of the communication system are missing from the terminal device, then the missing folders are downloaded into the terminal device.

updating of the folders of the terminal device over a general mobile telephone network, an Internet connection or some other appropriate communication connection when the passenger is outside the range of the local-area network of the communication system.

Having arrived in the building, the passenger only has access to those service folders which relate to the communication system of the building in question and from which the passenger can choose and activate a desired service request. The selection of service folders to be offered to the passenger in the communication system is made in the terminal device on the basis of the identification code of the communication system, said identification code being transmitted to the terminal device when the passenger arrives within the range of the local-area network of the communication system. Data indicating the service request selected from the service request folder is transmitted from the terminal device to the communication system server immediately, before activation of the service request, in response to which the passenger receives into his/her terminal device real-time status information relating to the service request selected, e.g. information indicating a company's open hours, situation regarding reservations in a restaurant, degree of loading of an elevator system, or other corresponding status information. Before executing the service request, the communication system server verifies the passenger's right of execution of the service request activated by the passenger, verifying things like information services and passenger's right of access to the destination. In FIG. 1, the access control server indicated by reference number 108, which manages access rights in the communication system, comprises a database 112 storing passengers' rights of access to different space in the building. A passenger's right of access comprises data indicating the space to which the access right applies, an access right code for access to the space in question and a time attribute defining the time during which the access right is valid. The access right code may consist of one or more identifiers identifying the passenger, such identifiers including the identification code of the terminal device, the PIN code/password, a handwriting identifier, fingerprint identification or some other corresponding identifier. A passenger may have several different access rights simultaneously active, e.g. so that he/she can access the lower floors of the building without limitations, the middle floors of the building by virtue of the identification code of the terminal device, but to gain access to the top floors of the building he/she must additionally enter via his/her terminal device a PIN code/password or another corresponding additional identifier. Passengers' rights of access are maintained by a party assigned or authorized for this function. Temporary access rights in the first place for visiting passengers can also be activated by a person using the communication system, within the limits of his/her rights of concession. In conjunction with the activation of access rights, the passenger's terminal device receives information regarding the activation and a possible PIN code/password.

The communication system server maintains and offers to the passenger default service requests on the basis of a passenger-specific criterion. This criterion may be either default service requests permanently defined or the service requests used by the passenger during the previous visit. Default service requests are tied to time and/or place in the building. The passenger can either accept or reject the default service request or select another service request instead of it.

The communication system server sends messages relating to service requests to the communication means included in the communication system. An example of such messages are the messages to the working hour monitoring server 109. When the passenger arrives in the entrance hall of the building and issues a service request to the floor where his/her working place is located, the communication system server generates a message regarding the passenger's arrival at his/her workplace to the working hour monitoring server 109. Correspondingly, when the passenger leaves the floor in question and arrives in the entrance hall of the building, the service request issued by the passenger generates a message to the working hour monitoring server regarding the passenger's exit from the workplace. In response to these messages, the working hour monitoring server transmits information relating to the passenger's working hours, such as e.g. the working hour balance, to the passenger's terminal device.

In the solution according to FIG. 1, the communication system server stores in a history database 113 history data related to the use of the communication system for later reference. The data to be stored include passengers' actual traveling routes and/or service requests issued by the passenger, together with time and place data.

In the solution according to FIG. 1, a buffer memory 111 is provided in which service requests can be stored beforehand for the passenger, the execution of which requests is automatically activated when the passenger arrives within the range of the local-area network of the communication system. When the passenger is outside the range of the local-area network, the passenger can perform the storing of the service request him/herself from the terminal device over an appropriate data transfer network, such as a general mobile telephone network, or the storing may be performed by some other person using the communication system from his/her terminal device. After execution, the service requests stored in the buffer memory are deleted from the buffer memory.

The terminal software installed in the passenger's terminal device contains a number of optional properties, from which the passenger can personalize an assembly of functions best suited for him/herself. The personalizable properties comprise one or more of the following:

- hands-free function for activation of the use of acoustic guidance information and/or voice commands in the terminal device,
- activation of indications associated with service requests, such as vibration and/or sound alarms of the terminal device,
- criterion of selection of a default service request, such criteria being permanent or previous service request based on time and/or passenger's location in the building,
- passenger's personal special needs, such as e.g. increased need for space utilization, extended door times, reservation of elevator car for personal use (VIP)
- content of service folders in the terminal device,
- language used by the communication system in messages to the passenger.

In addition, as an inventive idea applicable to the communication system according to FIG. 1, an embodiment is described wherein the passenger configures the sound signals of the communication devices via his/her terminal device. As an example, configuration of the aural environment of elevators is described wherein the passenger personalizes the sounds indicating the arrival of elevators at the entrance hall and/or at the floor. In this embodiment, the passenger, using his/her terminal device, sends to the communication system a code and/or sound file defining the aural environment, on the basis of which each elevator control system reproduces the personalized sounds when the passenger is using an elevator in the communication system.

Figure 3A:
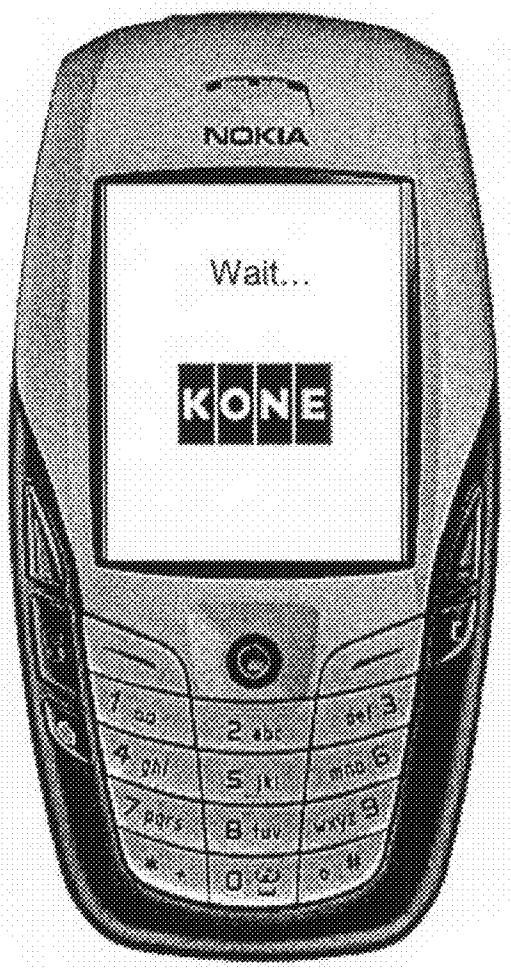
Figures 3B, 3C, 3D:
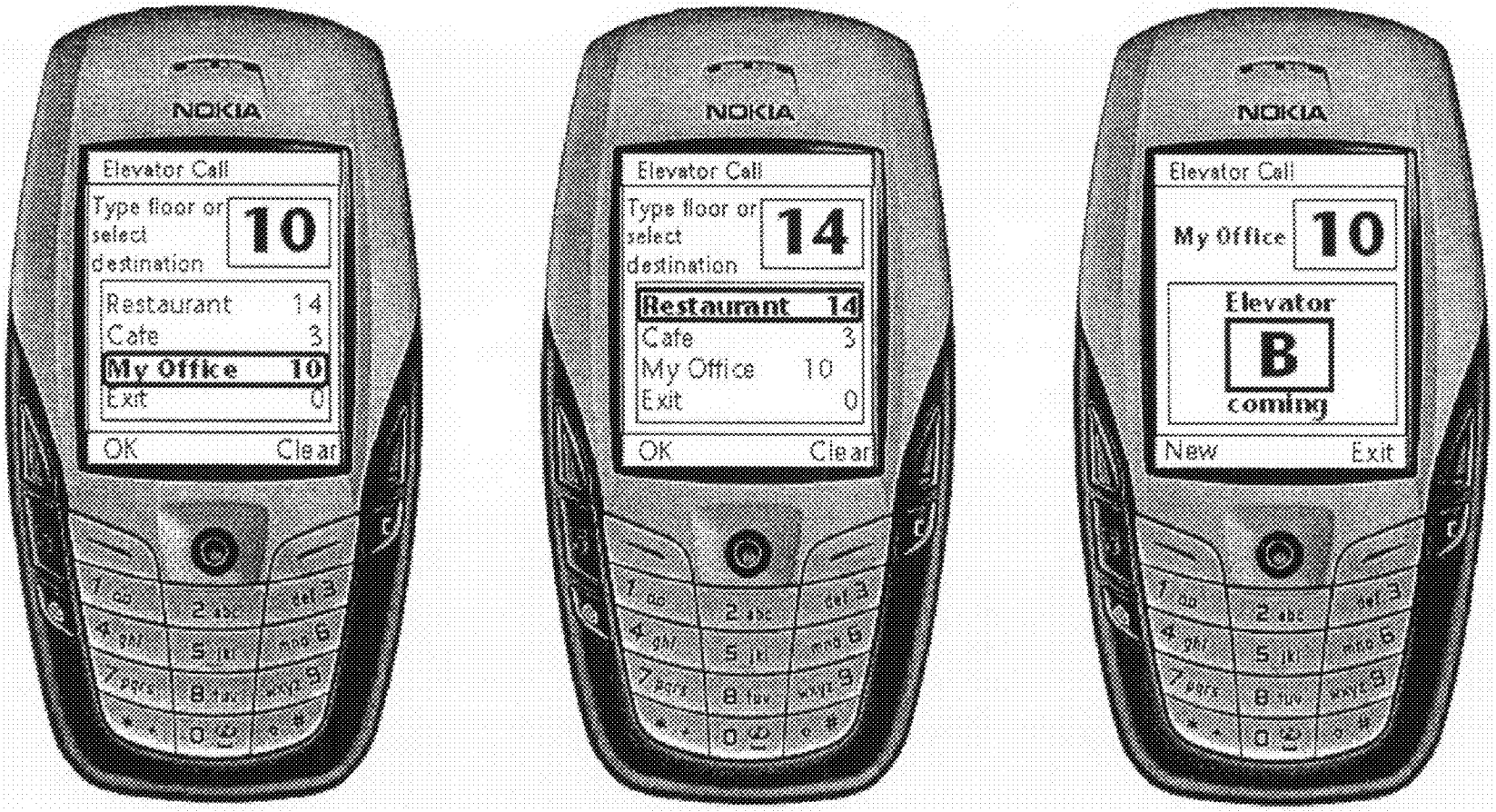

The issuing of service requests in a communication system according to FIG. 1 will now be described in the light of a few examples. When the passenger arrives in the building, the nearest base station of the communication system identifies the arriving passenger's terminal device, an intercommunication connection being now set up between the passenger's terminal device and the rest of the communication system. The terminal software in the terminal device receives data indicating that an intercommunication connection has been set up, whereupon a starting view (FIG. 3*a*) appears on the display of the terminal device and the terminal device produces a sound and/or vibration alarm to indicate that an intercommunication connection is established. Once the intercommunication connection is set up, the communication system server verifies the building-specific data of the terminal device, such as the service folders of the terminal device, and, if necessary, updates changed and missing data to the terminal device. If there are service requests stored in the buffer memory for the passenger, they are immediately executed. After the starting phase has ended, a selection window appears on the display of the terminal device, wherein the passenger's default service request, in the example in FIG. 3*b* "My Office", is high-lighted for selection. If the passenger wishes, he/she can select some other service request on his/her terminal device instead of the default service request, or accept or reject it. The passenger activates the high-lighted service request (My Office) by pressing the Ok-button of the terminal device, whereupon a destination floor call to floor 10 is transmitted from the terminal device to the communication system server. The communication system server receives and interprets the service request, verifies the passenger's right of execution of the service request and transmits a operating request corresponding to the service request to the group control 106 of the elevator system, which allocates an elevator to be used by the passenger to travel to the destination floor 10. The terminal device indicates an accepted service request to the passenger via sound and/or vibration alarm and opens implementation windows on the display of the terminal device during execution of the service request, showing the passenger information relating to the implementation of the service request. FIG. 3*d* presents an implementation window indicating to the passenger the identifier (B) of the elevator allocated to him/her. When the allocated elevator B arrives at the passenger's floor of entrance, the terminal device indicates arrival of the elevator via sound and/or vibration alarm and by replacing the window with the next implementation window, wherein the passenger is prompted to board the elevator B allocated to him/her (FIG. 3*f*). During the journey, the passenger can give new service requests, e.g. change his/her destination floor or ask for information services. On arrival of the elevator B at the passenger's destination floor 10, the terminal device indicates the arrival via a sound and/or vibration alarm signaling the end of execution of the service request.

Figure 4A:
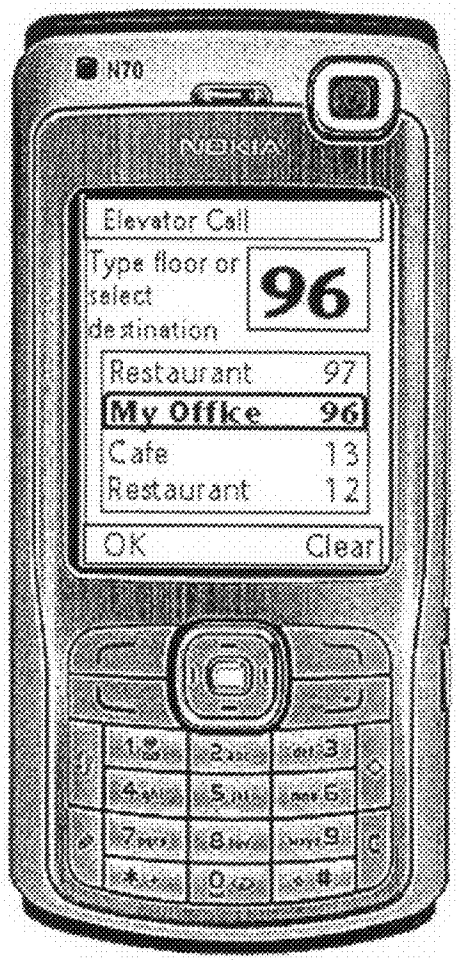
Figure 4B:
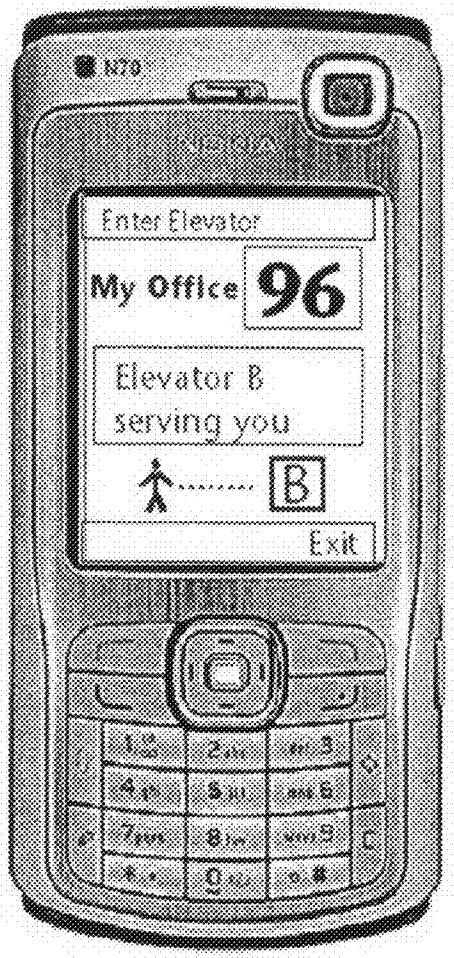
Figure 4C:
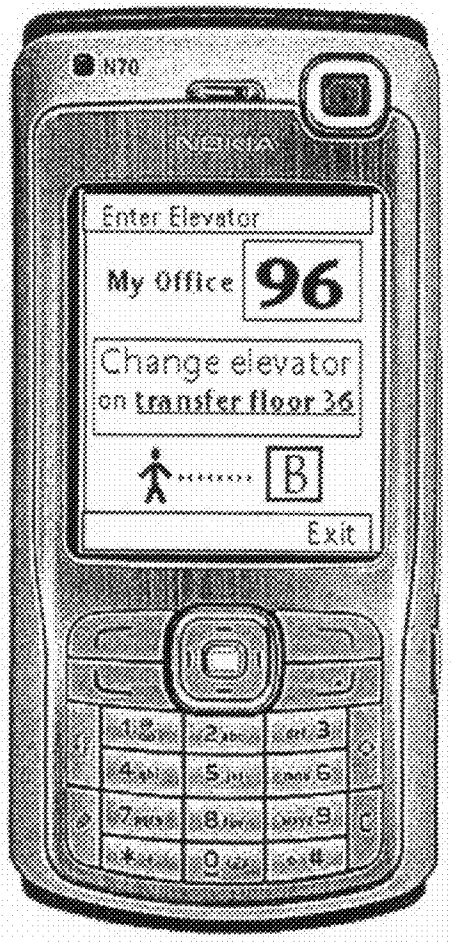
Figure 4D:
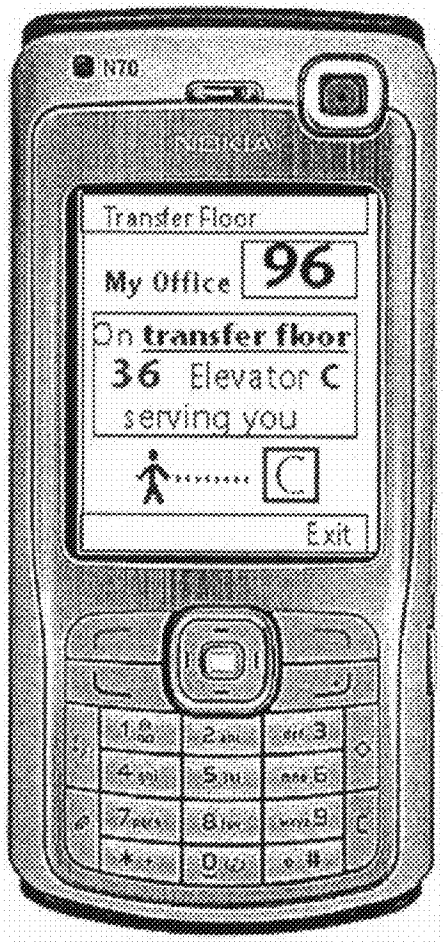

The route comprised in the passenger's service request may involve several different communication means, such as elevators, escalators and/or automatic doors. In this case, the terminal device guides the passenger as he/she is transferring from one communication means to another. FIG. 4*a* illustrates such a situation by way of example. A passenger has arrived in the entrance hall of the building and issues a service request as described above. The service request applies to the passenger's workplace (My Office), which is located on floor 96. The elevator system initially allocates elevator B to the passenger (FIG. 4*b*). During the journey, the passenger is informed that he/she is to change elevators on floor 36 (FIG. 4*c*). When elevator B arrives at floor 36, the elevator system has allocated elevator C for the passenger to travel from floor 36 to floor 96, and the passenger is informed about this via the terminal device (FIG. 4*d*). If the passenger has to use escalators, automatic doors or other corresponding communication means on his/her route, the system will guide the passenger correspondingly at different stages along the route.

Figure 2:
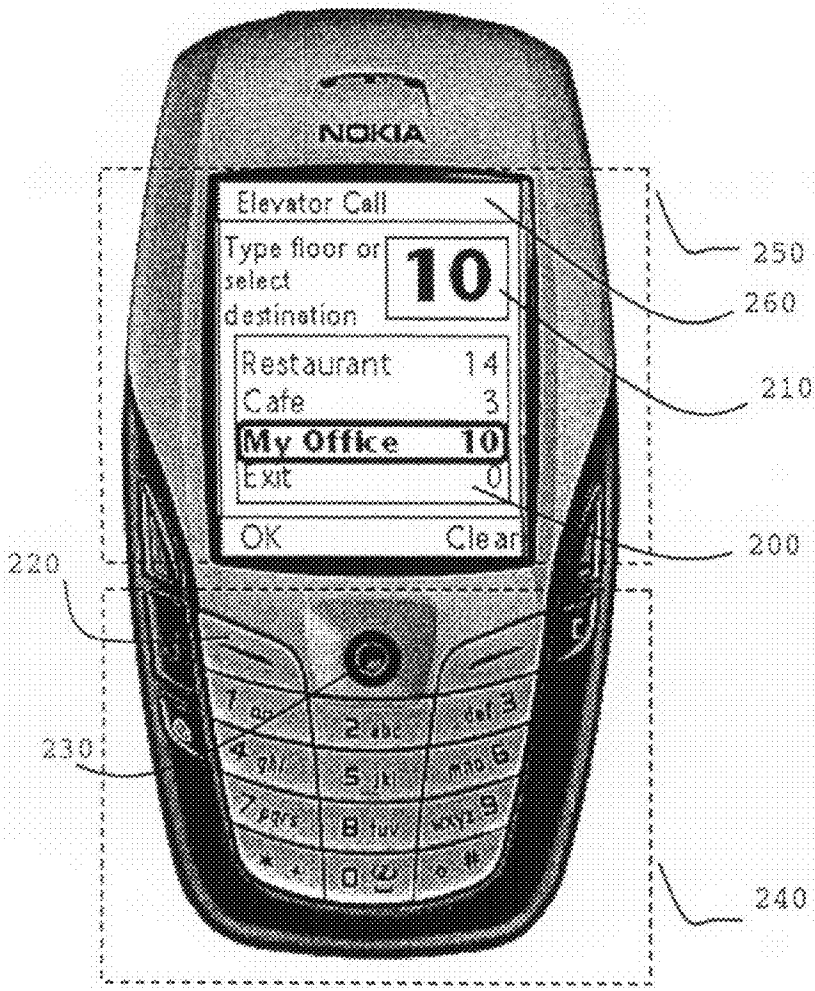

FIG. 2 presents by way of example a selection window for the selection of a destination floor from the Destination folder. Partition 200 of the display 250 of the terminal device presents a list of the service requests stored in the Destination folder, and partition 210 shows the destination floor for the service request selected from the list. On the service request list, the cursor is on service request "My Office", highlighting the selected service request. The passenger can activate the "My Office" service request by pressing the Ok button 220. Instead of the "My Office" service request, the passenger can select some other service request from the list 200 by moving the cursor up/down by means of the multi-function key 230 (navigator key) or by typing in the number of the desired destination floor directly from the keypad 240 of the terminal device. Using the multi-function key 230, the passenger can select some other service folder of the communication system for his/her use. In partition 250, status data relating to the selected service request is displayed alphanumerically, graphically and/or with background colors. Background colors can be used to indicate e.g. elevator waiting time as follows: green=short waiting time (0 . . . 30 s), yellow=medium waiting time (31 . . . 100 s), red=long waiting time (>100 s).

FIG. 5 presents an example of a Tenant folder. In partition 500, a list of personal names stored in the Tenant folder is displayed in alphabetic order. In partition 510, information relating to the person selected from the list is displayed, such as the person's picture, department, destination floor in the building and room number. The passenger can phone a desired person by selecting from the list 500 the name of the person in question and pressing the "Make call" key 250.

FIG. 3*e* presents an example of the implementation window when the passenger is using elevator B to travel to his/her destination floor (My Office). In partition 350 is shown the destination floor 34 for the journey, in partition 352 the current floor number 13, in partition 352 elevator position data (altitude measured in relation to the entrance hall), and in partition 351 the stopping floors 16,19,24,27 allocated for the elevator in order of stopping.

It is obvious to a person skilled in the art that different embodiments of the invention are not exclusively limited to the embodiment example described above, but that they may be varied within the scope of the claims presented below. It is obvious to a person skilled in the art that that servers of the communication system may be integrated in the same server computer or that the local network connecting the servers may be implemented by either wired or wireless technology.

The invention claimed is:

1. Method for producing services in the communication system of a building, where the communication system includes at least one portable terminal device applicable for local-area communication for the input of service requests to the communication system; at least one communication unit; at least one server controlling the communication system; at least one base station for implementing a local-area network in the communication system; and a local network for implementing mutual data transfer between said communication unit, said server controlling the communication system and said base station, method comprising the steps of:

generating a number of service folders in the terminal device, selecting a service folder from the said number and a service request from the selected service folder, and transmitting to the terminal device real-time status information relating to the service request selected from service folder before activation of the service request, wherein one or more default service requests are defined for the passenger, and each request is automatically selected as the passenger's service request depending on where the passenger is located in the building and/or on the traveling instant of time and on the basis of selection criteria configured in the communication system.

2. Method according to claim 1, the method further comprising the steps of:

sending the selected service request from the terminal device to the server controlling the communication system, and executing the service request sent to the server of the communication system in one or more sub-stages using one or more communication units.

3. Method according to claim 1, the method further comprising: verifying the passenger's right of execution implied by the service request to accept or reject the service request.

4. Method according to claim 1, wherein the selection criteria used for the selection of a default service request is either permanent selection or the passenger's previous service request selection.

5. Method according to claim 1, the method further comprising the steps of:

storing on the communication system server one or more service requests applicable to the passenger, and executing the stored service request upon the passenger's arrival within the range of the local-area network of the communication system.

6. Method according to claim 1, the method further comprising the step of updating the data in one or more service folders of the terminal device from a communication system server when the passenger arrives within the range of the local-area network of the communication system.

7. Method according to claim 1, wherein the number of service folders generated in the terminal device comprises at least one of the following service folders: tenant folder; destination folder; info-folder; emergency folder.

8. Method according to claim 7, wherein a passenger registered in the communication system defines information related to themselves in the information content of the tenant folder.

9. Method according to claim 7, wherein the status information transmitted to the passenger's terminal device consists of real-time information regarding accessibility of the person selected from the tenant folder and/or the place where the person is located in the building.

10. Method according to claim 2, wherein the method comprises the step of sending in conjunction with service requests a message indicating the passenger's arrival at his/her workplace or the passenger's exit from his/her workplace to a working hour monitoring system connected to the communication system.

11. Method according to claim 2, wherein the method further comprises the step of indicating the beginning and/or end of one or more sub-stages of the service request via vibration alarm and/or sound alarm of the terminal device.

12. Method according to claim 1, wherein the terminal device used is a mobile telephone, a PDA device or a portable computer.

13. Method according to 1, wherein method further comprises one or more steps of personalization of the terminal device, such as activation of hands-free functions of service requests, defining of personal traveling needs activation of sound and/or vibration alarms indicating the beginning and/or end of sub-stages of service requests selection of language used by the terminal device in connection with service requests modification of the contents of the service folders of the terminal device.

14. Method according to claim 2, wherein the communication unit is an elevator, and one or more of the following items of advice are indicated on the passenger's terminal device during the implementation of the service request:

elevator allocated to the passenger, passenger's destination floor, number of the current floor of the elevator allocated to the passenger, next stopping floors for the elevator allocated to the passenger, change floor in case the service request comprises several passages to be traveled on different elevators.

15. System for producing services in the communication system of a building, said communication system comprising:

at least one portable terminal device applicable for local-area communication for the generation of service requests to the communication system, at least one communication unit, at least one server controlling the communication system, and at least one base station for implementing a local-area network in the communication system, wherein the terminal device comprises a number of service folders formed in the terminal device and a selector for selecting service requests from the service folders in the said number of service folders, and the communication unit transmits, to the terminal device, real-time status information relating to the service request selected from service folder before activation of the service request; and further wherein one or more default service requests are defined for the passenger, and each request is automatically selected as the passenger's service request depending on where the passenger is located in the building and/or on the traveling instant of time and on the basis of selection criteria configured in the communication system.

16. System according to claim 15, wherein the terminal device sends the selected service request to the server controlling the communication system, and said at least one communication unit executes the service request sent to the server of the communication system in one or more sub-stages.

17. System according to claim 15, further comprising a verification portion that verifies the passenger's right of execution implied by the service request to accept or reject the service request.

18. System according to claim 15, wherein the criterion of selection of the default service request is of the following: permanent selection, passenger's previous service request.

19. System according to claim 15, the system further comprising a storage medium for storing one or more service requests assigned to the passenger and for executing said service request upon arrival of the passenger within the range of the local-area network of the communication system.

20. System according to claim 15, wherein a server in the communication system updates the data in one or more service folders when the passenger arrives within the range of the local-area network of the communication system.

21. System according to claim 15, wherein the service folders generated in the terminal device include at least one of:

tenant folder destination folder info-folder emergency folder.

22. System according to claim 21, wherein the information content of the tenant folder for a particular registered passenger is defined by that passenger.

23. System according to claim 21, wherein the system transmits, to the passenger's terminal device, status data including at least one of real-time information regarding the accessibility of the person selected from the tenant folder and, the place where the person is located in the building.

24. System according to claim 16, wherein the system sends, in conjunction with service requests, a message indicating the passenger's arrival at his/her workplace or the passenger's exit from his/her workplace to a working hour monitoring server connected to the communication system.

25. System according to claim 16, wherein the system is indicates a beginning or end of one or more sub-stages of the service request via vibration alarm or sound alarm of the terminal device.

26. System according to claim 15, wherein the terminal device is a mobile telephone, a PDA device or a portable computer.

27. System according to claim 15, wherein the terminal device is adapted to personalize one or more of the following functions:

hands-free functions of service requests, personal traveling needs, sound and/or vibration alarms indicating the beginning and/or end of sub-stages of service requests, language used by the terminal device in connection with service requests, content of service folders.

28. System according to claim 16, wherein, when the communication unit is an elevator, the terminal device indicates one or more of the following items of information during the implementation of the service request:

elevator allocated to the passenger, passenger's destination floor, number of the current floor of the elevator allocated to the passenger, next stopping floors for the elevator allocated to the passenger, change floor in case the service request comprises several passages to be traveled on different elevators.

* * * * *